US005166027A

United States Patent [19]

Machida et al.

[11] Patent Number: 5,166,027

[45] Date of Patent: Nov. 24, 1992

[54] FINE PARTICLES COMPOSING DEVELOPER FOR ELECTROPHOTOGRAPHY

[75] Inventors: Junji Machida, Toyonaka; Junji Ohtani, Kobe; Kazuo Ota, Toyohashi; Satoshi Asahi, Sodegaura; Hiroshi Hayashi, Tokyo; Kouichi Matono, Sodegaura, all of Japan

[73] Assignees: Minolta Camera Kabushiki Kaisha, Osaka; Idemitsu Kosan Company Limited, Tokyo, both of Japan

[21] Appl. No.: 727,983

[22] Filed: Jul. 10, 1991

[30] Foreign Application Priority Data

Jul. 12, 1990 [JP] Japan ..... 2-185513
Jul. 12, 1990 [JP] Japan ..... 2-185514

[51] Int. Cl.[5] ..... G03G 9/083

[52] U.S. Cl. ..... 430/106.6; 430/110; 430/111; 428/402

[58] Field of Search ..... 430/106, 106.6, 110, 430/111; 428/402

[56] References Cited

U.S. PATENT DOCUMENTS

| | | | |
|---|---|---|---|
| 3,819,367 | 6/1974 | Chatterji et al. | 252/62.1 |
| 4,564,647 | 1/1986 | Hayashi et al. | 523/211 |
| 4,797,339 | 1/1989 | Maruyama et al. | 430/109 |
| 4,917,982 | 4/1990 | Tomono et al. | 430/99 |

*Primary Examiner*—John Goodrow
*Attorney, Agent, or Firm*—Burns, Doane, Swecker & Mathis

[57] ABSTRACT

The present invention provides fine particles comprising core particles and polyolefinic resin layers for composing an electrostatic latent image developer, characterized in that the polyolefinic resin layers are formed by polymerizing olefinic monomers on surfaces of the core particles.

18 Claims, No Drawings

FINE PARTICLES COMPOSING DEVELOPER FOR ELECTROPHOTOGRAPHY

BACKGROUND OF THE INVENTION

The present invention relates to fine particles composing a developer used in an electrophotographic method, an electrostatic recording method, an electrostatic printing method, a magnetic recording method and the like.

The electrographic method is conducted as follows in general; electrical charges are uniformly applied to a photoconductive layer and exposed to lights in accordance with images, whereby electrostatic latent images are formed. Then the electrostatic latent images are developed by toner particles charged in a polarity opposite to that of the charges applied to the electrostatic latent images. The developed toner particles are transferred onto a transfer sheet, and fixed.

Toners used in such a development of electrostatic latent images are, in general, composed of fine particles such as colorants, magnetic particles and the like dispersed in binder resin.

However, if those fine particles are not uniformly dispersed in the binder resin, various kinds of harmful effects appear.

For example, if the coloring matters are not uniformly dispersed in the toner particles, electrical charges are not uniform among the toner particles and thus the toners which lack charges are liable to be produced to bring about scattering of toners, whereby fogged obscure images are formed. In addition, the scattering of toners causes also pollution of an inside of copying machine.

In order to improve dispersibility of colorants, the treatments of the colorants with metallic soaps, titanium coupling agents and silane coupling agents have been disclosed (for example Japanese Patent Application Laid-Open No. Sho 53-17735, Japanese Patent Application Laid-Open No. Sho 57-17737, Japanese Patent Application Laid-Open No. Sho 58-7648, Japanese Patent application Laid-Open No. Hei 1-145663 and the like) but in the present invention, surfaces of fine particles are coated with a polyolefinic resin. Accordingly, the present invention is quite different from that of the cited references in constitution. Furthermore, in order to prevent an off-set phenomenon, various kinds of wax have been added to toners (for example, Japanese Patent Application Laid-Open No. Sho 49-65232, Japanese Patent Application Laid-Open No. Sho 49-65231, Japanese Patent Application Laid-Open No. Sho 50-27546, Japanese Patent Application Laid-Open No. Sho 61-80261 and the like). However, if the wax is not uniformly dispersed in a binder resin of toner particles, a problem occurs in that a photosensitive member and the like are filmed with toners.

Besides, in order to prevent toners from scattering, magnetic particles are added to the toners. Since the magnetic particles are inorganic substances and inferior in dispersibility in the binder resin, a large amount of magnetic particles crop out and a content of magnetic particles is not uniform among toner particles. As a result, a transportability and a developability of toners become different and charging properties become unstable under humid conditions. The density of copied images becomes nonuniform.

In addition, in order to prevent blocking of toners and to improve fluidity, fine particles such as hydrophobic silica, alumina, titanium and the like have been added to toners (for example Japanese Patent Application Laid-Open No. Sho 46-12144, Japanese Patent Application Laid-Open No. Sho 48-47346, Japanese Patent Application Laid-Open No. Hei 1-142558, Japanese Patent Application Laid-Open No. Sho 55-120041, Japanese Patent Application Laid-Open No. Sho 60-186862 and the like), but when those fine particles are inferior in humidity resistance or weak in change of humidity, the functions of preventing a blocking and the fluidity are hindered and the quantity of charges on the toners is not uniform and thus serious problem occur in the scattering of toners and various kinds of harmful effects resulting from the scattering of toners.

On the other hand, various kinds of carriers for use in the electrophotographic developer have been proposed and repeatedly improved.

For example, electrically conductive carriers such as iron oxide particles are superior in solid developability but inferior in gradation properties, while coated insulating carriers are superior in gradation properties but inferior in solid developability.

In order to improve these disadvantages, binder-type carriers with fine particles such as ferrite particles, magnetic particles and the like dispersed in a binder resin have been proposed and practically used.

However, the magnetic particles are inorganic substances, while the binder resin is an organic substance. They are originally different to each other, so that an adherence of the magnetic particles to the binder resin is poor and thus the magnetic particles are liable to be broken away from the binder resin due to the collision of the carriers themselves or with the toners during the time when the developer is being stirred. As a result, the developer is not constant and unstable, in chargeability, and thus the quantity of charges on the toners is bad and not uniform, whereby problems are liable to occur in scattering of toners, fogging, pollution by toners and the like.

In addition, the magnetic particles give a bad influence upon the environmental stability and their chargeability is changed with a change in humidity and thus problems occur in the poor chargeability of toners, the scattering of toners, the fogging and the like.

As to an improvement of the environmental stability in respect of humidity, binder carriers with magnetic particles dispersed in a binder resin containing nonpolar resins such as polypropylenes and polyethylenes as an indispensable component have been proposed (for example Japanese Patent Application Laid-Open No. Sho 63-58360, Japanese Patent Application Laid-Open No. Sho 63-182667, Japanese Patent Application Laid-Open No. Hei 1-204071 and the like) but problems have occurred in that a bond strength of the magnetic particles to the polypropylenes or polyethylenes is weak and thus the magnetic particles are broken away from the binder resin during the mixing and stirring in a developing device to change the quantity of charges, whereby there arise the same problems as above described. In addition, since the polypropylene resins or the polyethylene resins used have a low molecular weight within a wax range, the developer aggregates and thus a problem occurs also in that the developer and the like are inferior useful life time.

SUMMARY OF THE INVENTION

The object of the invention is to provide fine particles composing a toner superior in dispersibility in resin and to improve stability in chargeability of toners, prevention of toner-scattering, prevention of off-set and prevention of fusing and filming to a photosensitive member.

Another object of the present invention is to provide fine particles superior in function as a fluidizing agent even under high humidity when added externally to toner particles.

It is a further object of the present invention to provide binder-type carriers superior in bond strength of magnetic particles to a binder resin, stability of chargeability even under the environment that a humidity is violently changed and durability without producing an aggregation, a scattering of toners, a fogging and the like.

The present invention relates to fine particles comprising core particles and polyolefinic resin layers for composing an electrostatic latent image developer for electrophotography, characterized in that the polyolefinic resin layers are formed by polymerizing olefinic monomers on surfaces of the core particles.

DETAILED DESCRIPTION OF THE INVENTION

The present invention provides a developer excellent in charging stability, prevention of toner scattering, prevention of off-set phenomenon, prevention of fusing and filming to a photosensitive member, even under high humidity.

The present invention has accomplished the above object by forming polyolefinic resin layers on the surfaces of fine particles composing a developer.

The present invention relates to fine particles comprising core particles and polyolefinic resin layers for composing a developer.

In the present invention, the fine particles composing a developer mean a toner, colorants for toners, magnetic particles for toners, fluidizing agents to be externally added to toners and magnetic particles for binder-type carriers.

In such fine particles composing a developer, surfaces of the fine particles are treated with a polymerization catalyst to directly polymerize olefinic monomers on the surfaces of fine particles, whereby the surfaces of fine particles are coated with a polyolefinic resin.

The colorants for toners, which are one kind of fine particles composing a developer, have a primary mean particle size of 7 to 50 mμm usually and include red pigments, such as red iron oxide, cadmium red, red lead oxide, cadmium, permanent red 4R, lithol red, pyrazolone red, watchung red, calcium salts, Lake red D, brilliant carmine 6B, eosine lake, rhodamine lake B, alizarin lake and brilliant carmine 3B and the like; violet pigments, such as manganese violet, fast violet B and methyl violet lake and the like; blue pigments, such as Prussian blue, cobalt blue, alkali blue lake, victoria blue lake, phthalocyanine blue, metal-free phthalocyanine blue, fast sky blue and indanthrene blue BC and the like; green pigments, such as chrome green, chrome oxide, pigment green B, malachite green lake and fanal yellow green G and the like; white pigments, such as zinc white, titanium oxide and antimony white and the like; black pigments, such as carbon blacks, for example furnace black, channel black, acetylene black and the like, or mixtures of nonmagnetic ferrite and the like and other colorants.

These colorants may be used in combination and not limitative but every organic or inorganic pollutionless colorant having a high coloring power can be used.

The dispersibility of the colorants in a binder resin of toners can be improved and the stability of chargeability of toners and the color tone of the copied image can be improved by treating the surfaces of these colorants with the polymerization catalyst to polymerize the olefinic monomers, whereby the surfaces of the colorants are coated with the polyolefinic resin.

In addition, since the coating resin is polyolefin, an off-set-preventing effect can be achieved, and the colorants having such a polyolefin resin are excellent in uniform dispersibility, so that consequently an effect equivalent to a uniform dispersion of the polyolefinic resin as an off-set preventing agent can be obtained and thus the fusing and filming of the toners to the photosensitive member caused by a lack of dispersibility of the off-set-preventing agent can be prevented. Furthermore, since the colorants are coated with the polyolefinic resin, the coloring agent particles themselves crop out on the surfaces of particles to a reduced extent, so that the colorants are superior in environmental stability, for example, under a high humidity.

With respect to the magnetic particles for toners as fine particles, they have a mean particle size of 0.01 to 2 μm.

The magnetic particles include metals, such as iron, nickel, cobalt, and the like, alloys or oxides of iron, nickel, cobalt, manganese, copper aluminum and the like, such as various kinds of ferrites, magnetites, and the like. According to the present invention, the dispersibility of the magnetic particles in the resin of the toners can be improved by treating the surfaces of the magnetic particles with the polymerization catalyst to polymerize the olefinic monomers, whereby the surfaces of the magnetic particles are coated with the polyolefinic resin and thus the nonuniformity of the content of magnetic particles among the toner particles can be prevented and the stability of chargeability can be improved.

Furthermore, since the magnetic particles are coated with the polyolefinic resin, the magnetic particles themselves crop out of the surfaces of particles to a reduced extent, so that the environmental stability, for example, under a high humidity can be improved.

Besides, since the magnetic particles are coated with the polyolefinic resins, an off-set-preventing effect can be achieved, and additionally the magnetic particles coated with the polyolefinic resin having the off-set-preventing effect are superior in uniform dispersibility, so that consequently an effect equivalent to a uniform dispersion of the polyolefinic resin as an off-set-preventing agent can be obtained and thus the fusing and filming of the toners to a photosensitive member caused by a lack of dispersibility of the off-set-preventing agent can be prevented.

With respect to the fluidizing agents added to toners in order to improve fluidity, they include silica, aluminum oxide, titanium oxide, a mixture of silica and aluminum oxide, and a mixture of silica and titanium oxide and the like.

The fluidizing agents superior in slip properties, fluidity, stability of chargeability at high temperature and low humidities, effect of preventing off-set phenomenon and cleaning properties can be obtained by treating surfaces of the fluidizing agents with the polymerization catalyst to polymerize olefinic monomers, whereby the surfaces of the fluidizing agents are coated with the polyolefinic resin.

With respect to the magnetic particles used for the binder-type carriers, surfaces of the magnetic particles are coated with the polyolefinic resin by treating the magnetic particles with the polymerization catalyst to directly polymerize olefinic monomers on the surfaces of the magnetic particles.

Since such a polyolefinic resin layer is directly polymerized on the surfaces of the magnetic particles, adhesivity and binding properties are remarkably excellent. Therefore, the resin layers are not easily separated from the magnetic particles. And, such polyolefinic resin layers are an organic resin layers, so that the magnetic particles coated with such resin layers are remarkably superior in dispersibility in the binder resin. As a result, the charging characteristics and magnetic forces of the carriers are kept stable and thus the scattering of toners, the fogging and the like do not occur.

In addition, the polyolefinic resin formed according to the present invention has a high molecular weight, so that also a problem of aggregation, which is caused in the case where low-molecular polyolefin is used, does not occur. Furthermore, as the magnetic particles coated with the polyolefinic resin are dispersed in the binder resin of the carriers according to the present invention, the carriers are particularly superior in environmental stability (at high temperature).

With respect to the magnetic particles used in the binder-type carriers, they have a mean particle size of about 0.01 to 2 μm and include those, which have been conventionally used in the binder-type carriers, for example, metals, such as ferrite, magnetite, iron nickel, cobalt, and the like, alloys or mixtures of these metals with metals such as zinc, antimony, aluminum, lead, tin, bismuth, beryllium, manganese, selenium, tungsten, zirconium, vanadium, and the like, metal oxide such as iron oxide, titanium oxide, magnesium oxide, and the like, nitrides such as chrome nitride, vanadium nitride and the like and carbides, such as silicon carbide, tungsten carbide, and the like, highly tough ferrites, mixtures thereof and the like.

The finally obtained binder-type carriers having a mean particle size of 20 to 100 μm are generally used but their size is suitably selected depending upon a developing method and the like. Generally speaking, if the particle size of the carriers is less than 20 μm, problems occur in that, for example, the carriers themselves are developed. On the other hand, if the particle size of the carriers is larger than 100 μm, a problem occurs in that an image quality is roughened.

Furthermore, it is desirable that an electric resistance of the carriers is $10^8$ to $10^{14}$ Ω·cm. If its value is less than $10^8$ Ω·cm, the carriers are developed and an quality of copied images lowered. On the other hand, if its value exceeds $10^{14}$ Ω·cm, an edge effect is increased and thus black solid copied images lack uniformity.

The binder-type carriers according to the present invention obtained in the above described manner are used as. a two-component developer in the form of a mixture with known toners.

According to the present invention, the polyolefinic resin layers are formed on the surfaces of the above described fine particles composing developer so that the polyolefinic resin may be coated on the fine particles in a quantity of 40 to 0.1 % by weight, preferably 30 to 1 % by weight, more preferably 20 to 3 % by weight, to the weight of the fine particles. If the content of the polyolefinic resin is outside of the above described range, the above described effects can not be obtained.

The polyolefinic resin layers can be formed by treating to the surfaces of fine particles composing a developer with a polymerization catalyst to polymerize olefinic monomers directly on the surfaces of fine particles. For example, the methods disclosed in U.S. Pat. No. 4,564,647 and in Japanese Patent Laid-Open No. Sho 60-106808 and Laid-Open No. Sho 60-106809 are suitable. The publications are herein cited as a part of the specification of the present invention. That is, such polyolefinic resin layers can be formed by polymerizing olefinic monomer such as ethylene or propylene on fine particles composing a developer which are treated in advance with a highly active catalyst ingredient containing titanium and/or zirconium and soluble to hydrocarbon solvents in the presence of organic aluminum compounds.

According to this forming method of polyolefins, the polyolefinic resin layers are directly formed on the surfaces of the fine particles composing a developer, so that the obtained layers are superior in strength and durability. In particular, in order to use polyolefin-coated fine particles as colorants and magnetic particles to be contained in toners, a weight average molecular weight should be $5 \times 10^2$ to $1 \times 10^4$, preferably $7 \times 10^2$ to $7 \times 10^3$, more preferably $1 \times 10^3$ to $5 \times 10^3$. If it is less than $5 \times 10^2$, a heat resistance is insufficient and the toners are liable to aggregate. On the other hand, if it exceeds $1 \times 10^4$, polyolefin is difficult to be molten during the fixation and a sufficient off-set-preventing effect can not be obtained.

In order to use the polyolefin-coated fine particles as a fluidizing agent, it is preferable that polyolefin has a weight average molecular weight of $1 \times 10^4$ to $5 \times 10^5$. If it is less than $1 \times 10^4$, the fluidity is deteriorated to cause the aggregation of toners. If it exceeds $5 \times 10^5$, adherence of polyolefin to the inorganic fine particles as the core materials is deteriorated and thus the inorganic fine particles are separated from polyolefin during mixing and stirring.

In the case where the polyolefin-coated fine particles are used as the magnetic particles for use in the binder-type carriers, a weight average molecular weight of polyolefin should be $5.0 \times 10^3$ to $5.0 \times 10^5$, preferably $1.0 \times 10^4$ to $4.5 \times 10^5$, more preferably $5.0 \times 10^4$ to $4.0 \times 10^5$. In this time, the polyolefinic resin layer excellent in strength of resin and adherence to the carriers can be formed.

If the weight average molecular weight is less than $5 \times 10^3$, the obtained binder-type carriers are inferior in heat resistance and durability during mixing and stirring. If it exceeds $5 \times 10^5$, a problem occurs in bond strength to the magnetic particles.

In order to further enhance the adherence of the polyolefinic resin layer to the fine particles composing a developer, it is effective to carry out an initial polymerization under the condition that the molecular weight is lowered. In addition, it can be confirmed by observing a surface condition of the fine particles composing a developer by means of an electron microscope to find surface irregularities and an existence of convex portions grown by the polymerization whether olefinic monomers are directly polymerized on the surfaces of the fine particles composing a developer or not.

The fine particles composing a developer according to the present invention can be used for the known two-component developers or single-component magnetic developers and their quantity added and the like may be suitably selected depending upon a kind of developer (two-component system, single-component system and the like), a use, a fixing method (heat fixation, pressure fixation and the like) and the like with reference to the known values. In addition, in the production of a developer, the fine particles composing a developer according to the present invention can be treated in the same manner as the conventional fine particles composing a developer to prepare the developer.

The present invention will be below described with reference to the preferred embodiments.

PRODUCTION EXAMPLE (1) of Toner

(1) Preparation of Titanium-containing Catalyst Ingredient

N-heptane, which had been dehydrated at room temperature, of 200 ml and magnesium stearate, which had been dehydrated at 120° C. under vacuum (2 mmHg), of 15 g (25 mmol) were put in a flask having the capacity of 500 ml replaced with argon to be turned into a slurry. Titanium tetrachloride of 0.44 g (2.3 mmol) was added drop by drop to the resulting slurry with stirring and them the resulting mixture was heated and subjected to a reaction for one hour with refluxing. A viscous and transparent solution of a titanium-containing catalyst ingredient was obtained.

(2) Evaluation of the Activity of the titanium-containing Catalyst Ingredient Dehydrated hexane of 400 ml, triethyl aluminum of 0.8 mmol, diethyl aluminum chloride of 0.8 mmol and the titanium-containing catalyst ingredient, which was obtained in the above described (1), of 0.004 mmol as titanium atoms were put in an autoclave having the capacity of 1 l replaced with argon and heated to 90° C. In this time, a pressure within a system amounted to 1.5 kg/cm$^2$G. Then, hydrogen was supplied to increase the pressure to 5.5 kg/cm$^2$G and ethylene was continuously supplied so that the total pressure might be kept at 9.5 kg/cm$^2$G. The polymerization was carried out for one hour to obtain a polymer of 70 g. The polymerization activity was 365 kg/g·Ti·Hr and the MFR (the molten fluidity at 190 ° C. under load of 2.16 kg; JIS k 7210) of the obtained polymer was 40.

(3) Reaction of Titanium-containing Catalyst Ingredient with Fillers and Polymerization of Ethylene Hexane, which had been dehydrated at room temperature, of 500 ml and magnetite particles (having a mean particle size of 0.5 μm), which had been dried for 3 hours at 200 ° C. under vacuum (2 mmHg), of 150 g were put in an autoclave having the capacity of 1 l replaced with argon and the stirring was started. Then, the temperature was increased to 40 ° C. and 0.1 mmol as titanium atoms of the titanium-containing polymerization catalyst ingredient obtained according to (1) above mentioned was added and the resulting mixture was subjected to a reaction about 1 hour. Then, diethyl aluminum chloride of 10 mmol was added and the resulting mixture was treated for 30 minutes. Triethyl aluminum of 15 mmol was added. The temperature was increased to 90 ° C. In this time, a pressure within a system amounted to 1.5 kg/cm$^2$G. Then, hydrogen was supplied to increase the pressure up to 5 kg/cm$^2$G followed by conducting the polymerization for 55 minutes with continuously supplying ethylene so that the total pressure might be kept at 7 kg/cm$^2$G to obtain a magnetite-containing polyethylene composition of 215 g in all, which was black.

Several samples were taken from this composition to measure a content of magnetite by means of TGA (thermal balance) with a result that all samples showed a uniform content of 70 ±0.1 wt%.

Furthermore, a weight average molecular weight measured by GPC method was 3.8 x 10$^3$

(4) Preparation of Toner

| | |
|---|---|
| Styrene-acrylic copolymer resin<br>Mean molecular weight ($\overline{M}n$): 5,600<br>Distribution of molecular weight<br>$\overline{M}w/\overline{M}n$): 38<br>Softening point: 128° C.<br>Glass-transition point 62° C. | 100 parts by weight |
| Carbon black MA #8 (made by Mitsubishi Kasei KK) | 3 parts by weight |
| The above described magnetite-containing polyethylene composition | 10 parts by weight |
| Charge-controlling agent; bontron N-01 (made by Oriento Kagaku Kogyo KK) | 8 parts by weight |

The above described materials were mixed in a Henschel mixer and then kneaded in a biaxial extrusion kneader followed by being finely pulverized in a jet mill and further pulverized and classified in a classifier to obtain toner (A) having a mean particle size of 10 μm.

PRODUCTION EXAMPLE (2) of toner

The titanium-containing catalyst component prepared according to (1) of PRODUCTION EXAMPLE (1) of toner was added to carbon black (having a particle size of 35 mμm) of 50 g in a quantity of 0.05 mmol in titanium atom in the same manner as in (3) of PRODUCTION EXAMPLE (1) of toner and then the resulting mixture was subjected to a reaction for 1 hour in an autoclave having an inner capacity of 1 litter and replaced with argon. Subsequently, diethylaluminum chloride of 5.0 mmol was added to carry out a reaction for 30 minutes followed by adding triethylaluminum of 7.5 mmol and heating the resulting mixture to 90° C. At this time, an inner pressure of system was 1.5 kg cm$^2$G. Then the resulting reaction mixture was supplied with the hydrogen to increase the inner pressure of system up to 5 kg/cm$^2$G followed by carrying out a polymerization for 40 minutes with continuously supplying the reaction mixture with ethylene so that the total pressure might be held at 7 kg/cm$^2$G. A carbon black-containing polyethylene composition uniformly assuming a black color of 61 g was obtained.

Several samples were taken from this composition to measure a content of carbon black by means of TGA (thermal balance) with a result that it was 82±0.1 wt% and a weight average molecular weight measured by GPC method was 4.5 × 10$^3$.

| | |
|---|---|
| Styrene-acrylic copolymer resin<br>Mean molecular weight ($\overline{M}n$): 5,600<br>Distribution of molecular weight<br>($\overline{M}w/(\overline{M}n)$: 38<br>Softening point: 128° C.<br>Glass-transition point: 62° C. | 100 parts by weight |
| The above described carbon black-containing polyethylene composition | 10 parts by weight |

-continued

| | |
|---|---|
| Charge-controlling agent Bontron N-01 (made by Oriento kagaku Kogyo KK) | 5 parts by weight |

The above described materials were mixed in a Henschel mixer and then kneaded in a biaxial extrusion kneader followed by being finely pulverized in a jet mill and further pulverized and classified in a classifier to obtain toner (B) having a mean particle size of 9 μm.

PRODUCTION EXAMPLE (3) of toner

| | |
|---|---|
| Styrene monomer | 180 g |
| Butyl methacrylate monomer | 30 g |
| The carbon black-containing polyethylene composition prepared in PRODUCTION EXAMPLE (2) of toner | 20 g |
| Azobisisobutyronitrile | 10 g |
| Charge-controlling agent (Bontron S-34 made by Orient Kagaku KK) | 3 g |

The above described materials were sufficiently mixed and the resulting mixture of the above described monomers was added to a separate 1 %-solution of polyvinyl alcohol in water of 1,000 cc with stirring in a T-K homomixer (made by Tokushu Kika Kogyo KK) and then the resulting mixture was stirred about 1 hour at 4,000 rpm.

Subsequently, the resulting mixture was heated to 60° to 80° C. to carry out a polymerization and then the resulting polymerization product was filtrated, washed and dried followed by being classified to obtain toner (C) having a mean particle size of 10 μm.

PRODUCTION EXAMPLE (4) of toner

| | |
|---|---|
| Styrene-acrylic copolymer resin · Mean molecular weight ($\overline{M}n$): 5,600 Distribution of molecular weight ($\overline{M}w/(\overline{M}n)$: 38 Softening point: 128° C. Glass-transition point: 62° C. | 100 parts by weight |
| Carbon black MA #8 (made by Mitsubishi Kasei KK) | 8 parts by weight |
| Charge-controlling agent Bontron S-34 (made by Orient Kagaku Kogyo KK) | 3 parts by weight |

The above described materials were mixed in a Henschel mixer and then kneaded in a biaxial extrusion kneader followed by being finely pulverized in a jet mill and further pulverized and classified in a classifier to obtain toner (E) having a mean particle size of 10 μm.

PRODUCTION EXAMPLE (5) of toner

| | |
|---|---|
| Styrene-acrylic copolymer resin Mean molecular weight ($\overline{M}n$): 5,600 Distribution of molecular weight ($\overline{M}w/(\overline{M}n)$: 38 Softening point: 128° C. Glass-transition point: 62° C. | 100 parts by weight |
| Carbon black MA #8 (made by Mitsubishi Kasei KK) | 8 parts by weight |
| Off-set-preventing agent (Viscol 660P made by Sanyo Kasei Kogyo KK) | 5 parts by weight |
| Charge-controlling agent (Bontron N-01 made by Oriento Kagaku Kogyo KK) | 3 parts by weight |

The above described materials were mixed in a Henschel mixer and then kneaded in a biaxial extrusion kneader followed by being finely pulverized in a jet mill and further pulverized and classified in a classifier to obtain toner (F) having a mean particle size of 10 μm.

The respective toners A to F obtained above of 100 parts by weight were post-treated with colloidal silica R-972 (made by Nippon Aerosil KK) of 0.1 parts by weight to be evaluated on various characteristics.

PRODUCTION OF CARRIER (a)

| Ingredient | Parts by weight |
|---|---|
| Polyester resin (softening point: 123° C., glass-transition point: 65° C., AV: 23, OHV: 40) | 100 |
| Fe—Zn series ferrite fine particles MFP-2 (made by TDK KK) | 500 |
| Carbon black (AM #8 made by Mitsubishi Kasei Kogyo KK) | 2 |

The above described materials were sufficiently mixed and pulverized in a Henschel mixer and then molten and kneaded in kneader in which a temperature of cylinder portion was set at 180 ° C. and a temperature of cylinder head portion was set at 170 ° C. After leaving as it is to be cooled, the kneaded mixture was roughly pulverized and additionally finely pulverized in a jet mill followed by being classified in a classifier. Carrier (a) having a mean particle size of 50 μm was obtained. The electric resistance was $8.7 \times 10^{13}$ Ω·cm,

EXAMPLE 1

A developer containing toner in a quantity of 7 wt% was obtained from the toner (A) prepared in PRODUCTION EXAMPLE (1) of toner and the carrier (a).

A quantity of charge on the toner was +15.8 μc/g. Then, a copying test with respect to durability was conducted by the use of this developer. In the copying test, a copying was carried out until the 50,000-th time under the environment that a temperature was 25° C. and a relative humidity was 50 %, from the 50,001-st until the 100,000-th time under the environment that a temperature was 35° C. and a relative humidity was 85 %, from the 100,001-st until 150,000-th time at five-continuous copy interval under the environment that a temperature was 10° C. and a relative humidity was 30 % from the 150,001-st until the 200,000-th time under the environment that a temperature was 25° C. and a relative humidity was 50 %, and from the 200,001-st to the 300,000-th time under the environment that temperature was 25° C. and a relative humidity was 50 % using EP-490Z (made by Minolta Camera KK) as a copying machine to evaluate a quantity of charge of toners, a concentration of copied images, a filming phenomenon and a spot. The results are shown in Table 2.

In addition, the quantity of charge on toners was measured in accordance with a method of measuring a distribution of charge in quantity disclosed in Japanese Patent Application Laid-Open No. Sho 63-292074.

Fixing properties were expressed by the following marks taking totally evaluations about fixing properties, which will be mentioned later, into consideration.

"◎": A width of non-off-set range is 100° C. or more.
"Δ": A with of non-off-set range is 30° C. to 50° C.
"-": A width of non-off-set range is 30° C. or less.

The filming phenomenon spots were evaluated by visually observing a surface of photosensitive member to be expressed by the following marks:

"◎": There are hardly films and spots on the photosensitive member and no problem about copied images.

"○": There are some films and spots on the photosensitive member and no problem about copied images.

"Δ": There are many films and spots on the photosensitive member and a problem in copied images.

"-": There are considerably many films and spots on the photosensitive member and a problem in copied images.

EXAMPLE 2

A developer containing toner in a quantity of 7 wt% was obtained from the toner (B) prepared in PRODUCTION EXAMPLE (2) of toner and the carrier (a).

A quantity of charge on the toner was +14.3 μc/g. Then, a copying test with respect to durability was conducted by the use of this developer. The evaluation was conducted in the same manner as in EXAMPLE 1. The results are shown in Table 2.

EXAMPLE 3

A developer containing toner in a quantity of 7 wt% was obtained from the toner (C) prepared in PRODUCTION EXAMPLE (3) of toner and the carrier (a).

A quantity of charge on the toner was −15.2 μc/g. Then, a copying test was conducted by the use of this developer in the same manner as in EXAMPLE 1. But, EP-570Z (made by Minolta Camera KK) was used as a copying machine. The results are shown in Table 2. Both a quantity of charge and a quality of copied images were stable and did not greatly fluctuated.

COMPARATIVE EXAMPLE 1

A developer containing toner in a quantity of 7 wt% was obtained from the toner (E) prepared in PRODUCTION EXAMPLE (4) of toner and the carrier (a).

A quantity of charge on the toner was − 15.6 μc/g. Then, a copying test was conducted by the use of this developer. The evaluation was conducted in the same manner as in EXAMPLE 3. The results are shown in

COMPARATIVE EXAMPLE 2

A developer containing toner in a quantity of 7 wt% was obtained from the toner (F) prepared in PRODUCTION EXAMPLE (5) of toner and the carrier (a).

A quantity of charge on the toner was +14.3 μc/g. Then, a copying test was conducted by the use of this developer. The evaluation was conducted in the same manner as in EXAMPLE 1. The results are shown in Table 2.

TEST OF FIXING PROPERTIES

Appointed toners and carriers were mixed to prepare two-component developers. Initial copied images, which were not fixed, were obtained by the use of these developers and EP-470Z (made by Minolta Camera KK) for EXAMPLES 1, 2 and COMPARATIVE EXAMPLE 2 and EP-570Z (made by Minolta Camera KK) for EXAMPLE 3 and COMPARATIVE EXAMPLE 1 and then the not-fixed images were fixed through between a fixing roller (60 Φ) coated with resin of teflon series and a LTV rubber roller, which was compressed against the fixing roller at the pressure of 10 Kg, and passed therebetween at the speed of 45 cm/sec. In this time, off-set at high temperature and off-set at low temperature were measured.

The off-set at high temperature means the phenomenon that toner particles adhering to a heat roller because of fusion or softening of the particles are transferred onto a copying paper at the second contact with a copying paper. The off-set at low temperature means the phenomenon that toner particles adhering not to copying paper but to a heat roller because of uncompletely fusion are transferred onto a copying paper at the second contact with a copying paper. Non-off-set width of 100° C. or more is required.

The fixing strength is the ratio % of reflection density of copied images before and after the copied images are erased with a sand eraser at the pressure of 1 kg.

The results about the above fixing properties are shown in Table 1.

TABLE 1

| | Fixing Properties | | | |
|---|---|---|---|---|
| | Generation Temperature of low-temperature off-set [°C.] | Generation Temperature of high-temperature off-set [°C.] | Width of a non-off-set range [°C.] | fixing strength [%] |
| EXAMPLE 1 | 130 | 240 | 110 | 92 |
| EXAMPLE 2 | 120 | 240 | 120 | 95 |
| EXAMPLE 3 | 140 | 240 | 100 | 90 |
| COMPARATIVE EXAMPLE 1 | 120 | 125 | 5 | 95 |
| COMPARATIVE EXAMPLE 2 | 120 | 240 | 120 | 95 |

Table 2.

TABLE 2

| | Kind of toners | initial charge quantity (μc/g) | Result of copying | | | | | | | | | | | | | | |
|---|---|---|---|---|---|---|---|---|---|---|---|---|---|---|---|---|---|
| | | | *1) From 1-st to 50,000-th time (25° C., 50% RH) | | | From 50,001-st to 100,000-th time (35° C., 85% RH) | | | From 100,001-st to 150,000-th time (10° C. 30% RH) | | | From 150,001-st to 200,000-th time (25° C. 50% RH) at regular intervals of 5 times | | | From 200,001-st to 300,000-th time (25° C. 50% RH) | | |
| | | | (1) | (2) | (3) | (1) | (2) | (3) | (1) | (2) | (3) | (1) | (2) | (3) | (1) | (2) | (3) |
| EXAMPLE 1 | A | +15.8 | +15.6 | ◎ | ◎ | +15.3 | ◎ | ◎ | +16.0 | ◎ | ◎ | +15.9 | ◎ | ◎ | +15.5 | ◎ | ◎ |
| EXAMPLE 2 | B | +14.3 | +14.2 | ◎ | ◎ | +13.9 | ◎ | ◎ | +14.5 | ◎ | ◎ | +14.5 | ◎ | ◎ | +14.4 | ◎ | ◎ |
| EXAMPLE 3 | C | −15.2 | −15.0 | ◎ | ◎ | −14.8 | ◎ | ◎ | −15.1 | ◎ | ◎ | −15.2 | ◎ | ◎ | −15.1 | ◎ | ◎ |
| COMPARATIVE EX- | E | −15.6 | −15.4 | — | — | — | — | — | — | — | — | — | — | — | — | — | — |

TABLE 2-continued

| | Kind of toners | initial charge quantity (μc/g) | Result of copying: *1) From 1-st to 50,000-th time (25° C., 50% RH) (1) | (2) | (3) | From 50,001-st to 100,000-th time (35° C., 85% RH) (1) | (2) | (3) | From 100,001-st to 150,000-th time (10° C. 30% RH) (1) | (2) | (3) | From 150,001-st to 200,000-th time (25° C. 50% RH) at regular intervals of 5 times (1) | (2) | (3) | From 200,001-st to 300,000-th time (25° C. 50% RH) (1) | (2) | (3) |
|---|---|---|---|---|---|---|---|---|---|---|---|---|---|---|---|---|---|
| AMPLE 1*2) | | | | | | | | | | | | | | | | | |
| COMPARATIVE EXAMPLE 2 | F | +14.3 | +14.0 | ◎ | ∘ | +13.3 | ◎ | X*3) | — | — | — | — | — | — | — | — | — |

*1)A mean quantity of charge after copying every 10,000 times is shown.
*2)Since a width of non-off-set range of the fixability was small, the copying was impossible.
*3)Since large number of films and spots were produced on the photosensitive member after copying 120,000 times under the environment that both a temperature and a humidity were high, the following copying test with respect to copy was stopped.
(1) Quantity of charge (μc/g).
(2) Fixing properties.
(3) Films and spots.

PRODUCTION EXAMPLE (6) of toner

Dehydrated hexane of 500 ml and titanium oxide (mean particle size: 35 mμ), which had been dried at 200° C. for 3 hours under the depressurized condition (2 mmHg), of 150 g were put in an autoclave having an inner capacity of 1 liter and replaced with argon and then the stirring was started. Subsequently, the resulting mixture was heated to 40° C. and then the titanium-containing catalyst component prepared in the above (1) described PRODUCTION EXAMPLE (1) of toner was added in a quantity of 0.05 mmol in titanium atom followed by carrying out a reaction about 1 hour. Then, diethylaluminum chloride of 5.0 mmol was added to carry out a reaction for 30 minutes followed by adding triethylaluminum of 7.5 mmol and heating the resulting mixture to 90° C. At this time, an inner pressure of system was 1.5 kg/cm$^2$. Then, the resulting reaction mixture was supplied with hydrogen to increase the inner pressure of system up to 1.5 kg/cm$^2$G followed by carrying out a polymerization for 55 minutes with continuously supplying the reaction mixture with ethylene so that the total pressure might be held at 5.5 kg/cm$^2$ to obtain a titanium oxide-containing polyethylene composition uniformly assuming a white color of 215 g.

Several samples were taken from this composition to measure a content of titanium oxide by means of TGA (thermal balance) with a result that all samples showed a uniform content of 70±0.1 wt%.

Furthermore, a weight average molecular weight measured by the GPC method was 8.3 × 10$^4$.

| | |
|---|---|
| Styrene-acrylic copolymer resin<br>Mean molecular weight ($\overline{M}$n): 5,300<br>Distribution of molecular weight<br>($\overline{M}$w/($\overline{M}$n): 42<br>Softening point: 125° C.<br>Glass-transition point: 60° C. | 100 parts by weight |
| Carbon black MA #8 (made by Mitsubishi Kasei KK) | 8 parts by weight |
| Charge-controlling agent Bontron N-01 (made by Oriento Kagaku Kogyo KK) | 3 parts by weight |
| Off-set-preventing agent (Viscol 550P made by Sanyo Kasei Kogyo KK) | 5 parts by weight |

The above described materials were mixed in a Henschel mixer and then kneaded in a biaxial extrusion kneader followed by being finely pulverized in a jet mill and further pulverized and classified in a classifier to obtain toner having a mean particle size of 6 μm.

The titanium oxide-containing polyethylene composition of 2 parts by weight was added to the above described toner of 100 parts by weight and the resulting mixture was mixed for 1 minute at 1,500 rpm followed by being sieved through a sieve of 105 μm to obtain toner (G).

PRODUCTION EXAMPLE (7) of toner

The titanium-containing catalyst component prepared according to (1) of PRODUCTION EXAMPLE (1) of toner was added to silicon dioxide (a mean particle size: 1.5 μm) of 50 g in a quantity of 0.01 mmol in titanium atom in the same manner as in (3) of PRODUCTION EXAMPLE (1) of toner and then the resulting mixture was subjected to a reaction for 1 hour in an autoclave having an inner capacity of 1 liter and replaced with argon. Subsequently, diethylaluminum chloride of 1.0 mmol was added to carry out a reaction for 30 minutes followed by adding triethylaluminum of 1.0 mmol and heating the resulting mixture of 90° C. At this time, an inner pressure of system was 1.5 kg/cm$^2$G.

Then, the resulting reaction mixture was polymerized for 80 minutes with continuously supplying the reaction mixture with ethylene so that the total pressure might be held at 5.5 kg/cm$^2$G. A silicon dioxide-containing polyethylene composition uniformly assuming a white color of 65 g was obtained.

Several samples were taken from this composition to measure a content of silicon dioxide by means of TGA (thermal balance) with a result that it was 94±0.1 wt% and a weight average molecular weight measured by the GPC method was 1.8 × 10$^5$.

| | |
|---|---|
| Styrene-acrylic copolymer resin<br>Average molecular weight ($\overline{M}$n): 5,300<br>Distribution of molecular weight<br>($\overline{M}$w/($\overline{M}$n): 42<br>Softening point: 125° C.<br>Glass-transition point: 60° C. | 100 parts by weight |
| Carbon black MA #8 (made by Mitsubishi Kasei KK) | 8 parts by weight |
| Charge-controlling agent (Spilon black TRH made by Hodogaya Kagaku Kogyo KK) | 3 parts by weight |
| Off-set-preventing agent (Viscol 550P made by Sanyo Kasei Kogyo KK) | 5 parts by weight |

The above described materials were mixed in a Henschel mixer then kneaded in a biaxial extrusion kneader followed by being finely pulverized in a jet mill and further pulverized and classified in a classifier to obtain toner having a mean particle size of 5 μm.

The silicon dioxide-containing polyethylene composition of 1 part by weight was added to the above described toner of 100 parts by weight and the resulting mixture was mixed for 1 minute at 1,500 rpm in a Henschel mixer followed by being sieved through a sieve of 105 μm to obtain toner (H).

PRODUCTION EXAMPLE (8) of toner

The titanium oxide-containing polyethylene composition obtained in PRODUCTION EXAMPLE (6) of toner of 1.5 parts by weight and the silicon dioxide-containing polyethylene composition obtained in PRODUCTION EXAMPLE (6) of toner of 0.5 parts by weight were added to the toner having a mean particle size of 6 μm obtained in PRODUCTION EXAMPLE (6) of toner of 100 parts by weight and the resulting mixture was mixed for 1 minute at 1,500 rpm in a Henschel mixer followed by being sieved through a sieve of 105 μm to obtain toner (I).

PRODUCTION EXAMPLE (9) of toner

The toner having a mean particle size of 6 μm obtained in PRODUCTION EXAMPLE (6) of toner of 100 parts by weight and hydrophobic titanium oxide (T-805 made by Nippon Aerosil KK) of 2 parts by weight were treated in the same manner as in PRODUCTION EXAMPLE (6) of toner to obtain toner (J).

PRODUCTION EXAMPLE (10) of toner

The toner having a mean particle size of 5 μm obtained in PRODUCTION EXAMPLE (7) of toner of 100 parts by weight and hydrophobic silica (R-972 made by Nippon Aerosil KK) of 1 part by weight were treated in the same manner as in PRODUCTION EXAMPLE (7) of toner to obtain toner (K).

PRODUCTION EXAMPLE (11) of toner

Hydrophobic silica (R-972) of 0.2 parts by weight was treated in the same manner as in PRODUCTION EXAMPLE (10) of toner to obtain toner (L).

EXAMPLE (4)

A developer containing toner in a quantity of 5 wt% was obtained from the toner (G) prepared in PRODUCTION EXAMPLE (6) of toner and the carrier (a).

A quantity of charge and a scattered quantity of this developer were measured under the environment that a temperature was 25° C. and a relative humidity was 50 %. In addition, the quantity of charge and the scattered quantity of this developer after storing for 48 hours under the environment that a temperature was 30° C. and a relative humidity was 85 %, the environment that a temperature was 25 ° C. and a relative humidity was 50 %, the environment that a temperature was 10° C. and a relative humidity was 30 % and the environment that a temperature was 25° C. and a relative humidity was 50 %, was measured respectively. The results are shown in Table 3.

A bulk specific gravity was measured, the results are shown in Table 3.

In addition, the quantity of charge was measured in the same manner as the above described.

The scattered quantity was measured by means of a digital dust meter of P5H2 type (made by Shibata Kagaku KK). This dust meter and a magnet roll were arranged at an interval of 10 cm and the developer of 2 g was put on the magnet roll followed by reading out a quantity of toner particles scattered when the magnet roll was rotated at 2,000 rpm by means of the dust meter to display the scattered quantity in the form of a counted number per 1 minute (cpm).

The bulk specific gravity was measured in accordance with JIS K-5101. The larger its value is, the larger the fluidity is.

The quantity of charge on toner in the developer obtained in EXAMPLE 4 was +22.3 μc/g under the environment that a temperature was 25° C. and a relative humidity (RH) was 50 %. A change in quantity of charge of this developer under the environments (30° C., 85 % RH and 10° C., 30 % RH) was small and this developer was superior in fluidity.

EXAMPLE (5)

A developer containing toner in a quantity of 6 wt% was obtained from the toner (H) obtained in PRODUCTION EXAMPLE (7) of toner and the carrier (a).

This developer was evaluated in the same manner as in EXAMPLE 4. The results are shown in Table 3.

EXAMPLE (6)

A developer containing toner in a quantity of 5 wt was obtained from the toner (I) obtained in PRODUCTION EXAMPLE (8) of toner and the carrier (a).

This developer was evaluated in the same manner as in EXAMPLE (4), the results are shown in Table 3.

COMPARATIVE EXAMPLE (3)

A developer containing toner in a quantity of 5 wt% was obtained from the toner (J) obtained in PRODUCTION EXAMPLE (9) of toner and the carrier (a).

This developer was evaluated in the same manner as in EXAMPLE (4). The results are shown in Table 3.

COMPARATIVE EXAMPLE (4)

A developer containing toner in a quantity of 5 wt% was obtained from the toner (K) obtained in PRODUCTION EXAMPLE (10) of toner and the carrier (a).

This developer was evaluated in the same manner as in EXAMPLE (4). The results are shown in Table 3.

COMPARATIVE EXAMPLE (5)

A developer containing toner in a quantity of 5 wt% was obtained from the toner (L) prepared in PRODUCTION EXAMPLE (11) of toner and the carrier (a).

This developer was evaluated in the same manner as in EXAMPLE (4). The results are shown in Table 3.

TABLE 3

| | Kind of toners | Chargeability | | | | | | | | | | Bulk specific density [g/cc] |
|---|---|---|---|---|---|---|---|---|---|---|---|---|
| | | 25° C., 50% RH | | 30° C., 85% RH (after stored for 48 hours) | | 25° C., 50% RH (after stored for 48 hours) | | 10° C., 30% RH (after stored for 48 hours) | | 25° C., 50% RH (after stored for 48 hours) | | |
| | | (1) | (2) | (1) | (2) | (1) | (2) | (1) | (2) | (1) | (2) | |
| EXAMPLE 4 | G | +22.3 | 72 | +20.1 | 84 | +22.0 | 74 | +22.9 | 68 | +22.2 | 73 | 0.386 |
| EXAMPLE 5 | H | −25.7 | 53 | −23.6 | 64 | −25.8 | 52 | −26.0 | 56 | −25.8 | 52 | 0.413 |
| EXAMPLE 6 | I | +21.5 | 76 | +19.8 | 86 | +21.2 | 78 | +21.8 | 75 | +21.4 | 75 | 0.401 |
| COMPARATIVE | J | −20.3 | 83 | −9.1 | 2735 | −18.3 | 94 | −23.6 | 66 | −19.0 | 91 | 0.375 |

TABLE 3-continued

| | Kind of toners | Chargeability 25° C., 50% RH (1) | (2) | 30° C., 85% RH (after stored for 48 hours) (1) | (2) | 25° C., 50% RH (after stored for 48 hours) (1) | (2) | 10° C., 30% RH (after stored for 48 hours) (1) | (2) | 25° C., 50% RH (after stored for 48 hours) (1) | (2) | Bulk specific density [g/cc] |
|---|---|---|---|---|---|---|---|---|---|---|---|---|
| EXAMPLE 3 | | | | | | | | | | | | |
| COMPARATIVE EXAMPLE 4 | K | −27.5 | 43 | −5.6 | 3652 | −25.1 | 56 | −32.1 | 17 | −30.3 | 27 | 0.393 |
| COMPARATIVE EXAMPLE 5 | L | −18.9 | 90 | −16.3 | 105 | −18.0 | 96 | −20.1 | 84 | −17.0 | 102 | 0.314*1 |

*The toners were poor in fluidity and the blocking occurred.
(1): Quantity of charge (μc/g).
(2): Scattered quantity (cpm).

PRODUCTION EXAMPLE (I) of carriers

Dehydrated hexane of 500 ml and magnetite particles (EPT-1000; made by Toda Kogyo KK) (mean particle size: 0.5 μ) had been dried at 200° C. for 3 hours under the depressurized condition (2mmHg), of 150 g were put in an autoclave having an inner capacity of 1 liter and replaced with argon and then the resulting mixture was stirred. Subsequently, the resulting mixture was heated to 40° C. and then the titanium-containing catalyst component prepared in the above described (1) of PRODUCTION EXAMPLE (1) of toner was added in a quantity of 0.05 mmol in titanium atom followed by carrying out a reaction about 1 hour. Then, diethylaluminum chloride of 5.0 mmol was added to carry out a reaction for 30 minutes. Triethylaluminum of 7.5mmol was added and the resulting mixture was heated to 90° C. At this time, an inner pressure of system was 1.5 kg/cm$^2$G Then, the resulting reaction mixture was supplied with hydrogen to increase the inner pressure of system up to 2 kg/cm$^2$G followed by carrying out a polymerization for 55 minutes with continuously supplying the reaction mixture with ethylene so that the total pressure might be held at 6 kg/cm$^2$G to obtain a magnetite-containing polyethylene composition uniformly assuming a black color of 215 g.

Several samples were taken from this composition to measure a content of magnetite by means of TGA (thermal balance) with a result that all samples showed a uniform content of 70 ±0.1 wt%.

The above described magnetite-containing polyethylene composition was kneaded in a pressure kneader and then sprayed, cooled and classified by the use of a spray drier under the molten condition with keeping its temperature at 170° C. to obtain binder-type carrier (I) having a mean particle size of 50 μm.

PRODUCTION EXAMPLE (II) of carrier

The titanium-containing catalyst component prepared in (1) of PRODUCTION EXAMPLE (1) of toner was added to ferrite fine particles of Zn series (maximum magnification: 72 emu/g, HC: 110, volume resistance: 3 × 10$^8$ Ω·cm) of 500 g in a quantity of 0.01 mmol in titanium atom in an autoclave having an inner capacity of 1 liter and replaced with argon in the same manner as PRODUCTION EXAMPLE (I) of carrier followed by carrying out a reaction about 1 hour. Then, diethylaluminum chloride of 1.0 mmol was added to carry out a reaction for 30 minutes followed by adding triethylaluminum of 1.5 mmol and heating the resulting mixture to 90° C. At this time, an inner pressure of system was 1.5 kg/cm$^2$G. Then, the resulting reaction mixture was supplied with hydrogen to increase the inner pressure of system up to 2 kg/cm$^2$G followed by carrying out a polymerization for 30 minutes with supplying the reaction mixture with ethylene of 7 g (A quantity of ethylene supplied was confirmed by measuring a weight of a gas cylinder). At this time, the inner pressure of system was reduced to 2.5 kg/cm$^2$G from 4.7 kg/cm$^2$G. The obtained ferrite composition of Zn series uniformly assumed a black color.

Several samples were taken from this composition to measure a content of Zn series ferrite fine particles by means of TGA (thermal balance) with a result that all samples showed a uniform content of 99±0.1 wt%.

| | |
|---|---|
| Polyethylene resin (Mean molecular weight (Mn): 1 × 10$^4$) | 100 parts by weight |
| Carbon black (Ketchen black EC made by Lion Aczo KK) | 1.5 parts by weight |
| The above described Zn series ferrite composition | 800 parts by weight |

The above described materials were mixed in a Henschel mixer and kneaded in a pressure kneader, sprayed, cooled in a spray drier and classified under the molten condition with keeping its temperature at 170° C. to obtain binder-type carrier (II) having a mean particle size of 80 μm.

PRODUCTION EXAMPLE (III) of carrier

The titanium-containing catalyst component prepared in (1) of PRODUCTION EXAMPLE (1) of toner was added to Zn series ferrite fine particles (maximum magnification: 72 emu/g, HC: 110, volume resistance: 3 × 10$^8$ Ω·cm) of 500 g in a quantity of 0.06 mmol in titanium atom in an autoclave having an inner capacity of 1 liter and replaced with argon in the same manner as PRODUCTION EXAMPLE (I) of carrier followed by carrying out a reaction about 1 hour. Then, diethylaluminum chloride of 6.0 mmol was added to carry out a reaction for 30 minutes followed by adding triethylaluminum of 1.5 mmol and heating the resulting mixture to 90° C. At this time, an inner pressure of system was 1.5 kg/cm$^2$G. Then, the resulting reaction mixture was supplied with hydrogen to increase the inner pressure system up to 2 kg/ cm$^2$G followed by carrying out a polymerization for 70 minutes with continuously supplying the reaction mixture with ethylene so that the total pressure might be held at 6 kg/cm$^2$G to obtain a Zn series ferrite-containing polyethylene composition of 556 g. The obtained Zn series ferrite composite uniformly assumed a black color and several samples were taken from this composite to measure a content of Zn series ferrite fine particles by means of TGA (thermal balance) with a result that all samples showed a uniform content of 90 ± 0.1 wt%

| | |
|---|---|
| Polyester resin (Softening point: 120° C., Glass transition point: 62° C.) | 100 parts by weight |
| Silica (Aerosil #200 made by Nippon Aerosil KK) | 1 part by weight |
| The above described Zn ferrite polyethylene composition | 600 parts by weight |

The above described materials were mixed in a Henschel mixer and kneaded in a pressure kneader and then finely pulverized in a jet mill and classified in a classifier to obtain binder-type carrier (III) having a mean particle size of 40 μm.

PRODUCTION EXAMPLE (IV) of carrier

| | |
|---|---|
| Polyethylene wax (density: 0.93 at 20° C., weight average molecular weight: 2,000, softening point: 107° C.) | 100 parts by weight |
| Magnetic particles (EPT-1000; made by Toda Kogyo KK) | 500 parts by weight |
| Silica (Aerosil #200; made by Nippon Aerosil KK) | 1.5 parts by weight |

The above described materials were sufficiently mixed in a Henschel mixer and molten and kneaded in a pressure kneader followed by being pulverized in a turbomill and classified in a classifier to obtain binder-type carrier (IV) having a mean particle size of 80 μm.

PRODUCTION EXAMPLE (V) of carrier

| | |
|---|---|
| Styrene-acrylic copolymer resin (Softening point: 125° C., glass transition point: 60° C.) | 100 parts by weight |
| Silica (Aerosil #200 made by Nippon Aerosil KK) | 1 part by weight |
| Magnetic particles (EPT-1000 made by Toda Kogyo KK) | 500 parts by weight |

The above described materials were sufficiently mixed in a Henschel mixer and molten and kneaded in a pressure kneader followed by being pulverized in a turbomill and classified in a classifier to obtain binder-type carrier (V) having a mean particle size of 50 μm.

Mean particle sizes and electric resistance of the binder-type carriers obtained in PRODUCTION EXAMPLES (I) to (V) of carrier are collected in Table 4.

In addition, the mean particle size was measured by means of SALD 1000 (made by Shimazu Seisakusho).

The electric resistance was determined by placing a sample on a metallic circular electrode in a thickness of 1 mm and a diameter of 50 mm and then putting an electrode having a mass of 895.4 g and a diameter of 20 mm and a guard electrode having an inside diameter of 38 mm and an outside diameter of 42 mm on the sample. A value of electric current after the lapse of 1 minute was read out to convert it into a value $\rho$ of volume intrinsic resistance of the sample. A measuring environment that a temperature was 25 ±1° C. and a relative humidity was 55±5% was selected. The measurement was repeated 5 times and a mean value was taken from results of these measurements.

PRODUCTION of (-) Chargeable Toner [Toner (a)]

| Ingredient | Parts by weight |
|---|---|
| Polyester resin (softening point: 130° C., glass-transition point: 60° C., AV: 25, OHV: 38) | 100 |
| Carbon black (AM #8 made by Mitsubishi Kasei Kogyo KK) | 8 |
| Dyestuff (Spilon black TRH made by Hodogaya Kagaku Kogyo KK) | 3 |

The above described materials were sufficiently mixed in a ball mill and then kneaded in a 3-roll mill heated to 140° C. The resulting mixture was left as it was to be cooled and then roughly pulverized in a feather mill followed by finely being pulverized in a jet mill. Subsequently, the resulting particles were subjected to a pneumatic classification to obtain fine particles [toner (a)] having a mean particle size of 10 μm.

PRODUCTION of (+) Chargeable Toner [Toner (b)]

Toner (b) having a mean particle size of 10 μm were produced from the following materials in the same manner as in PRODUCTION of (−) Chargeable Toner [Toner (a)].

| Ingredient | Parts by weight |
|---|---|
| Styrene-n-butyl copolymer resin Softening point: 132° C. Glass-transition point: 60° C. | 100 parts by weight |
| Carbon black MA #8 (made by Mitsubishi Kasei KK) | 5 parts by weight |
| Charge-controlling agent Bontron P-51 (made by Oriento Kagaku Kogyo KK) | 3 parts by weight |

EXAMPLE (7)

A developer containing toner in a quantity of 7 wt% was obtained from the binder-type carrier (I) prepared in PRODUCTION EXAMPLE (I) of carrier and the toner (b).

A quantity of charge on toner in this developer was +15.8 μc/g. Subsequently, a copying test with respect to durability was conducted by the use of this developer.

In the copying test, a copying was carried out until the 100,000-th time under the environment that a temperature was 25° C. and a relative humidity was 50 %, from the 100,001-st until the 150,000-th time under the environment that a temperature was 35° C. and a relative humidity was 85 %, from the 150,001-st until 200,000-th time under the environment that a temperature was 10° C. and a relative humidity was 30 %, and from the 200,001-st until the 500,000-th time under the environment that a temperature was 25° C. and a relative humidity was 50 % using EP-490Z (made by Minolta Camera KK) as a copying machine to evaluate a quantity of charge on toners and a concentration of copied images (on the first stage, after copying of 100,000 times, after copying of 150,000 times, after copying of 200,000 times and after copying of 500,000 times). The results are shown in Table 4. Both a quantity of charge and concentration of copied images were stable and not greatly fluctuated.

The quantity of charge on toners was measured in accordance with a method of measuring a distribution of charge in quantity disclosed in Japanese Patent Application Laid-Open No. Sho 63-292074. The concentration of copied images was measured by means of a Sakura densitometer.

EXAMPLE (8)

A developer containing toner in a quantity of 4 wt% was obtained from the binder-type carrier (II) prepared in PRODUCTION EXAMPLE (II) of carrier and the toner (b). A quantity of charge on toner in this developer was +13.6 μc/g. Subsequently, this developer was evaluated in the same manner as in EXAMPLE 7. The results are shown in Table 4.

EXAMPLE (9)

A developer containing toner in a quantity of 8 wt% was obtained from the binder-type carrier (III) prepared in PRODUCTION EXAMPLE (III) of carrier and the toner (a). A quantity of charge on toner in this developer was −14.0 μc/g. Subsequently, this developer was evaluated in the same manner as in EXAMPLE 7 by the use of EP-570Z. The results are shown in Table 4.

COMPARATIVE EXAMPLE 6

A developer containing toner in a quantity of 4 wt% was obtained from the binder-type carrier (IV) prepared in PRODUCTION EXAMPLE (IV) of carrier and the toner (b). A quantity of charge on toner in this developer was +12.8 μc/g. Subsequently, this developer was evaluated in the same manner as in EXAMPLE 7. The results are shown in Table 4.

COMPARATIVE EXAMPLE 7

A developer containing toner in a quantity of 7 wt% was obtained from the binder-type carrier (V) prepared in PRODUCTION EXAMPLE (V) of carrier and the toner (a). A quantity of charge on toner in this developer was − 12.3 μc/g. Subsequently, this developer was evaluated in the same manner as in EXAMPLE 9. The results are shown in Table 4.

TABLE 4

| | Physical properties of carriers | | | Quantity of charge |
|---|---|---|---|---|
| | particle size (μM) | Electric resistance (Ω · CM) | Kind of toners | on the initial stage (μc/g) |
| EXAMPLE 7 (carrier I) | 50 | $6.3 \times 10^{12}$ | b | +15.8 |
| EXAMPLE 8 (carrier II) | 80 | $5.5 \times 10^{10}$ | b | +13.6 |
| EXAMPLE 9 (carrier III) | 40 | $3.9 \times 10^{10}$ | a | −14.0 |
| COMPARATIVE EXAMPLE 6 (carrier IV) | 80 | $7.3 \times 10^{13}$ | b | +12.8 |
| COMPARATIVE EXAMPLE 7 (carrier V) | 50 | $2.5 \times 10^{14}$ | a | −12.3 |

| | Results of copying | | | | | | | |
|---|---|---|---|---|---|---|---|---|
| | From 1-st to 100,000-th time (25° C., 50% RH) | | From 100,001-st to 150,000-th time (35° C., 85% RH) | | From 150,001-st to 200,000-th time (10° C., 30% RH) | | The rest (25° C., 50% RH) | |
| | (1) | (2) | (1) | (2) | (1) | (2) | (1) | (2) |
| EXAMPLE 7 (carrier I) | +15.5 | 1.14 | +15.2 | 1.15 | +15.8 | 1.13 | +15.4 | 1.14 |
| EXAMPLE 8 (carrier II) | +13.5 | 1.25 | +13.1 | 1.27 | +13.6 | 1.24 | +13.4 | 1.25 |
| EXAMPLE 9 (carrier III) | −13.9 | 1.21 | −13.6 | 1.23 | −14.0 | 1.20 | +13.8 | 1.22 |
| COMPARATIVE EXAMPLE 6 (carrier IV) | +9.2*1 | — | — | — | — | — | — | — |
| COMPARATIVE EXAMPLE 7 (carrier V) | −11.9 | 1.34 | −7.6*2 | — | −15.9 | 1.12 | −9.8 | 1.13 |

*1Since the aggregation occurred within a developing device, the following copying test with respect to durability was stopped.

*2A large amount of toner was scattered and thus an inside of the copying machine was polluted. In addition, the fogging occurred to a great extent.

(1): Quantity of charge (μc/g).

(2): Concentration of copied images.

What is claimed is:

1. Fine particles comprising core particles and polyolefinic resin layers for composing an electrostatic latent image developer for electrophotography, wherein said polyolefinic resin layers are formed by polymerizing olefinic monomers directly on surfaces of the core particles.

2. The fine particles as set forth in claim 1, wherein said core particles are previously treated with a polymerization catalyst.

3. The fine particles as set forth in claim 1, wherein said polyolefinic resin layers are contained in the fine particles in a quantity of 0.1 to 40% by weight.

4. The fine particles as set forth in claim 1, wherein said polyolefinic resin layers have convex portions grown by a polymerization.

5. Toner particles for developing electrostatic latent images comprising a thermoplastic resin and colorant particles coated with polyolefinic resin layers, the polyolefinic resin layers being formed by polymerizing olefinic monomers directly on surfaces of the colorant particles.

6. The toner particles as set forth in claim 5, wherein a primary means particle size of the colorant particles is 7 to 50 mμm.

7. The toner particles as set forth in claim 5, wherein said polyolefinic resin has a weight average molecular weight of $5 \times 10^2$ to $1 \times 10^4$.

8. Toner particles for developing electrostatic latent image comprising a thermoplastic resin, coloring matters and magnetic particles coated with polyolefinic resin layers, the polyolefinic resin layers being formed by polymerizing olefinic monomers directly on surfaces of the magnetic particles.

9. The toner particles as set forth in claim 8, wherein said magnetic particles have a mean particle size of 0.01 to2 μm.

10. The toner particles as set forth in claim 8, wherein said polyolefinic resin has a weight average molecular weight of $5 \times 10^2$ to $1 \times 10^4$.

11. An electrostatic latent image developer comprising toner particles containing a thermoplastic resin and colorant particles, and fluidizing agent particles coated with polyolefinic resin layers, the polyolefinic resin layers being formed by polymerizing olefinic monomers directly on surfaces of the fluidizing agent particles.

12. The electrostatic latent image developer as set forth in claim 11, wherein said fluidizing agent is silica, aluminum oxide, titanium oxide, a mixture of silica and aluminum oxide or a mixture of silica and titanium oxide.

13. The electrostatic latent image developer as set forth in claim 11, wherein said polyolefinic resin has a weight average molecular weight of $1 \times ]10^4$ to $5 \times 10^5$.

14. An electrostatic latent image developer comprising magnetic carrier particles with polyolefinic resin-coated magnetic particles dispersed in a resin and toner particles containing a thermoplastic resin and a colorant, the polyolefinic resin layer being formed by polymerizing olefinic monomers directly on surfaces of the magnetic particles.

15. The electrostatic latent image developer as set forth in claim 14, wherein said magnetic particles have a mean particle size of 0.01 to 2 μm.

16. The electrostatic latent image developer as set forth in claim 14, wherein said polyolefinic resin has a weight average molecular weight of $5 \times 10^3$ to $5 \times 10^5$.

17. The electrostatic latent image developer as set forth in claim 14, wherein said carrier particles have a mean particle size of 20 to 100 μm.

18. The electrostatic latent image developer as set forth in claim 14, wherein said carrier particles have an electric resistance of $10^8$ to $10^{14}$ Ω·cm.

* * * * *